US007373704B1

(12) United States Patent
Blacklock

(10) Patent No.: US 7,373,704 B1
(45) Date of Patent: May 20, 2008

(54) METHOD AND APPARATUS FOR LIFTING OBJECTS FOR TRANSFERRING THE OBJECTS TO ANOTHER LOCATION

(76) Inventor: Wayne L. Blacklock, 505 N. Sunnyslope Ave., Pasadena, CA (US) 91107

( * ) Notice: Subject to any disclaimer, the term of this patent is extended or adjusted under 35 U.S.C. 154(b) by 208 days.

(21) Appl. No.: 11/134,924

(22) Filed: May 23, 2005

(51) Int. Cl.
*A61G 1/00* (2006.01)

(52) U.S. Cl. ..... 27/28; 294/110.1

(58) Field of Classification Search ..... 27/28; 294/110.1, 106, 118, 50.8
See application file for complete search history.

(56) References Cited

U.S. PATENT DOCUMENTS

| | | | | |
|---|---|---|---|---|
| 1,033,277 | A * | 7/1912 | Seashole | 5/86.1 |
| 2,125,546 | A * | 8/1938 | Corr | 5/86.1 |
| 2,638,657 | A * | 5/1953 | Arnold | 27/28 |
| 4,318,365 | A * | 3/1982 | Eriksson | 119/728 |
| 7,207,612 | B2 * | 4/2007 | Raney | 294/110.1 |

OTHER PUBLICATIONS

Texas Directory—, 2 pages , Commercial Literature of Guldmann, Inc. USA of Tampa, Florida; Apr. 2005.

Body Scoop Lifts Profits, 1 page, Guldmann Commercial literature, Mar. 2005.

Never Lift Again, 1 page, Guldmann Commercial Literature Approximately Apr. 19, 2004.

Never, Everlift Again, Guldmann Body Scoop, 1 page, approximately Apr. 4, 2005.

Guldmann Lifting Accessories, 8 pages, Jan. 2003, commercial literature of Guldmann, Inc. USA, Mar. 2004.

* cited by examiner

*Primary Examiner*—William L. Miller
(74) *Attorney, Agent, or Firm*—Edward J. DaRin, Inc.; Edward J. DaRin, Esq.

(57) ABSTRACT

A mechanical lifting mechanism for lifting bodies and/or objects for transport. The lifting mechanism has a pair of spaced vertical arms and a horizontal arm connecting the vertical arms and arranged in an inverted U. The vertical arms are adjustable in length in accordance with the size of the object to be lifted and carry lifting means at the free ends thereof. The lifting mechanism includes a pair of cross arms connected at one end in common at a supporting arm arranged between the vertical arms. The cross arms each have an end pivotably connected to an individual vertical arm for moving the vertical arms outwardly of their vertical positions. The supporting arm extends through the horizontal arm and includes a swivel for coupling to a source for imparting vertical movements to the lifting mechanism.

14 Claims, 9 Drawing Sheets

~CEILING~
R
HO
CB
SS
SWV
TH
HA
3
HC
HAL
HAR
OTR
LM
OTL
LAL
LAR
LPL
LPR
AA
AA
ITL
ITR
LE
LE
S
S
SCR
SCL
SCE
SCE
3

METHOD AND APPARATUS FOR LIFTING OBJECTS FOR TRANSFERRING THE OBJECTS TO ANOTHER LOCATION

FIELD OF INVENTION

The present invention relates to a method and apparatus for lifting and transfer of objects and more particularly to a mortuary body lifting assemblies and methods for hoisting a body and transferring the body from a supporting surface to a casket.

BACKGROUND OF INVENTION

The handling of patients in both hospitals and mortuaries has been done manually for years including up to the present time. Manual handling includes rolling a human body toward you and then lifting the body with your legs. Manual handling also involves a 2 to 3 person sheet transfers for transferring a patient from a bed to a gurney or the like. At a mortuary, a dead body must be transferred from a table, after the mortician has prepared the body for burial, to a casket. This usually requires two people to effect the lifting. If the corpse is of an extra heavy or large person, it may require 3 workers to effect the desired lifting of the body. These old methods can cause back injuries to the body handling personnel that could be career ending and liabilities to their employers. In addition, these old methods leave the body handling personnel overly fatigued and more likely to sustain injury in continuing to handle bodies by these old procedures.

It is known that attempts have been made in the recent past to utilize a single person to operate a ceiling mounted rail and hoist structure with lifting apparatuses for transferring a body in a mortuary. This prior apparatus utilized a state of the art rail and hoist ceiling mounted structure that utilized a double, scissor type lifting structure having a pair of body scoop elements for engaging and supporting a body to be lifted and transported to a casket. This structure was abandoned due to the fact that the spacing between the scoop elements was not wide enough to be useful with different body widths. In addition, the length of the double, scissor type structure required so much vertical length that all present day room heights, 7-8 feet, could not accommodate the necessary double, scissor type structure to be useful in rooms of reduced height, further leading to the commercial abandonment of such a structure.

SUMMARY OF INVENTION

The present invention contemplates an improved method and apparatus of lifting and transporting an object or body from one location to another and will be specifically described for use in a mortuary for use by a mortician in transferring a prepared corpse from a table to a casket without the need of another person to aid in lifting. This description will reveal other uses for the apparatus including for transferring patients in a hospital.

From a method standpoint the present invention contemplates the use of the improved lifting apparatus with a conventional rail and hoist structure for operation by a single person, without lifting the corpse or object to be lifted and transported. The method comprehends providing a lifting mechanism having a pair of spaced, vertically oriented lifting arms having arcuate scooping elements dependent from the arms in a pre-determined non-movable angular relationship for scooping up and lifting the scooped body in response to the operation of the hoist for lowering the lifting arms to position the scooping elements to straddle the body on the opposite sides of the body to be transferred The continuous downward operation of the hoist causing the lifting arms to engage the supporting surface for the body to be elevated and causing the scooping elements to move under the body to be supported thereon to allow the lifting of the scooped body from the supporting surface without the need for the hoist operator moving the body in aiding the lifting action. The improved lifting mechanism is coupled to the hoist structure for the rail and hoist combination. The method further contemplates adjusting the operative lengths of the lifting arms in accordance with the size of the body or object to be lifted. The lifting arms are pivotably arranged to cause them to move outwardly to fully open for straddling and engaging extra large bodies to be lifted.

From a broad structural standpoint, the present invention contemplates a body lifting mechanism comprising a U-shaped element having two vertical lifting arms spaced apart a pre-selected distance and a horizontal arm secured between the vertical arms adjacent the ends of the vertical arms and normally arranged in an inverted U-configuration for lifting purposes. The vertical lifting arms having a pre-selected operative length and being constructed and defined for permitting the lengths of the lifting arms to be adjusted in length and secured at the adjusted lengths. The operative lengths of the two lifting arms being the same. A supporting arm is mounted to extend through the horizontal arm of the U-shaped element and extend therethrough a pre-selected distance on opposite sides of the horizontal arm and carried thereby. The end of the supporting arm extending above the horizontal arm carries mounting means for coupling the supporting arm to a source for imparting vertical movements, up and down, to the U-shaped element. The structure further includes a pair of cross arms for the U-shaped element with one end of the supporting arm including means for securing an end of each cross arm thereto. The remaining ends of the cross arms being individually, secured to individual one of the vertical lifting arms adjacent the lower ends of the lifting arms. Lifting means, for supporting an object or body to be elevated and transported in the lifting means, is secured to the ends of the lifting arms.

The structure further contemplates the adjustment in length of the lifting arms including the pivotal movements of the lifting arms outwardly from the vertical orientation for accommodating extra large objects or bodies during the lifting operation. The lifting apparatus may utilize lifting means in the form of lifting scoops secured to each arm, that are movable under the object or body to be lifted in response to the forces applied to the lifting mechanism, upon the lifting arms engaging the supporting surface of a body or object to be lifted and transported to a new location such as placement in a casket.

BRIEF DESCRIPTION OF THE DRAWINGS

These and other features of the present invention may be more fully appreciated when considered in light of the following specification and drawings, in which.

DETAILED DESCRIPTION OF THE PREFERRED EMBODIMENT

Figure 1:
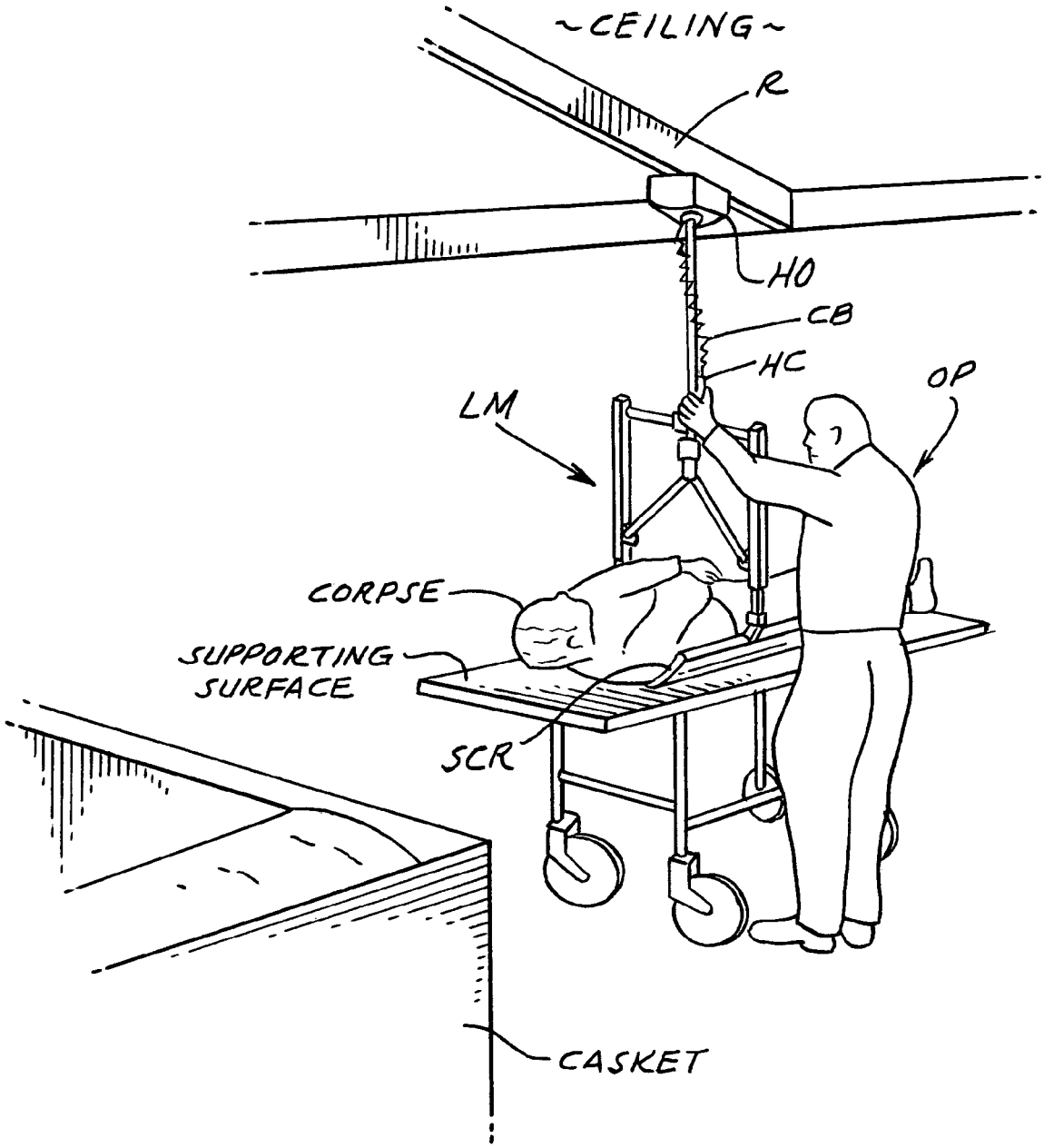
FIG. 1 is a diagrammatic illustration of the lifting mechanism embodying the present invention as it may be utilized in a hospital morgue and or mortuary and illustrating the lifting mechanism suspended from a ceiling by a rail and hoist transporting assembly operative by a single individual for lifting and transporting a corpse or the like from a table to a casket.

Now referring to the drawings, the present invention will be described in detail. The invention will be described in the form of the preferred embodiment for use in a morgue or mortuary for transporting a body, a dead body, that has been prepared for burial, to be transported to a casket in the same room, as illustrated in FIG. 1. It should be appreciated at the outset, that the lifting mechanism may be utilized for lifting other objects such as live bodies including individuals with disabilities, packages, etc. and the scooping elements can be modified in shape for lifting the particular object or use other elements for engaging and lifting the object to be elevated such as lifting slings and/or turning slings for use in a hospital or healthcare facility or any place of business equipped with a hoist. All of such objects or bodies are contemplated as objects to be elevated by the present invention and teachings.

Figure 2:
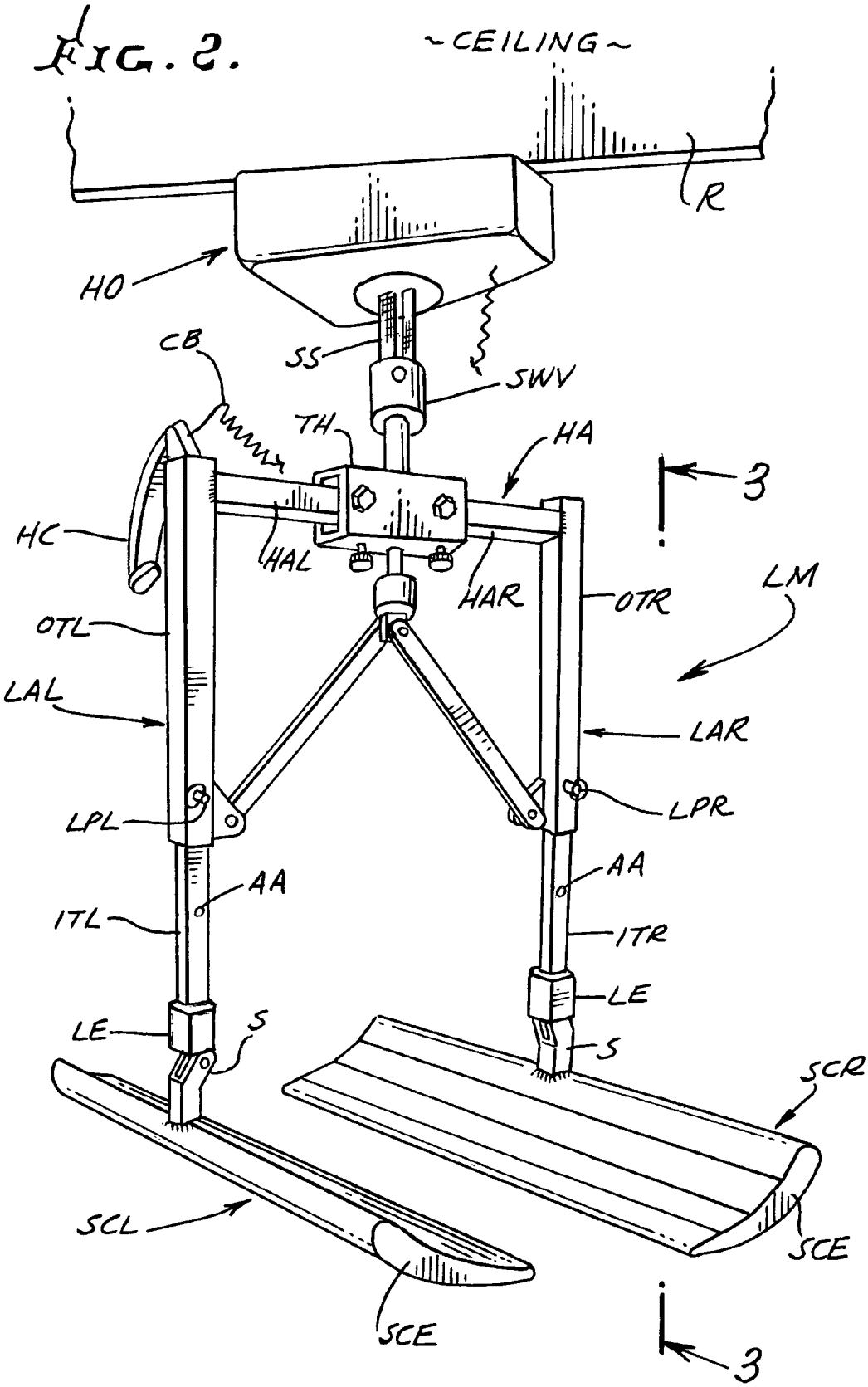
FIG. 2 is an enlarged view of the lifting mechanism of FIG. 1 suspended from a ceiling having a rail or hoist transporting assembly mounted thereto and the hand control for the hoist illustrated as being supported on the lifting mechanism.
Figure 3:
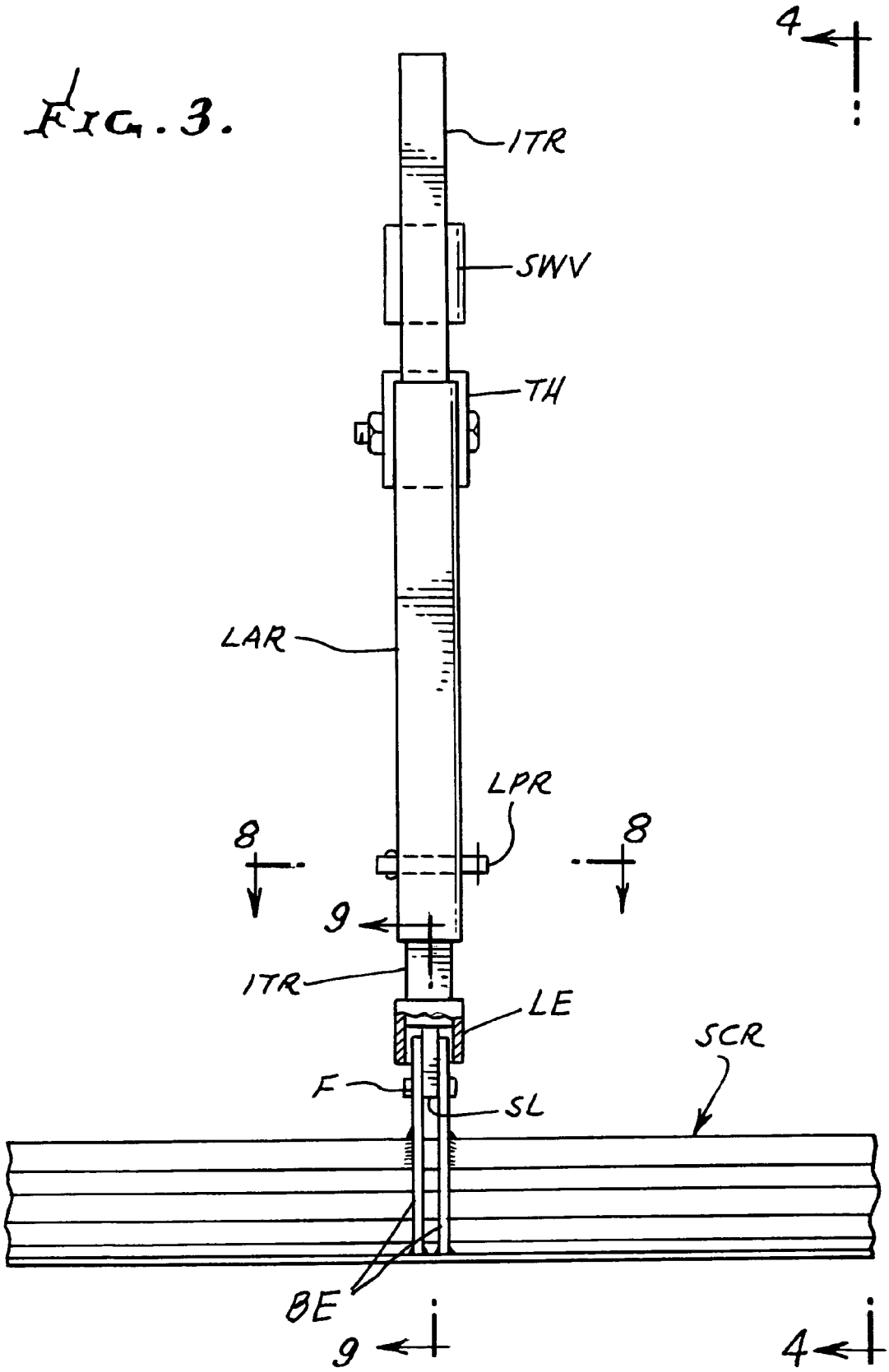
FIG. 3 is a view taken along the line 3-3 of FIG. 2.
Figure 4:
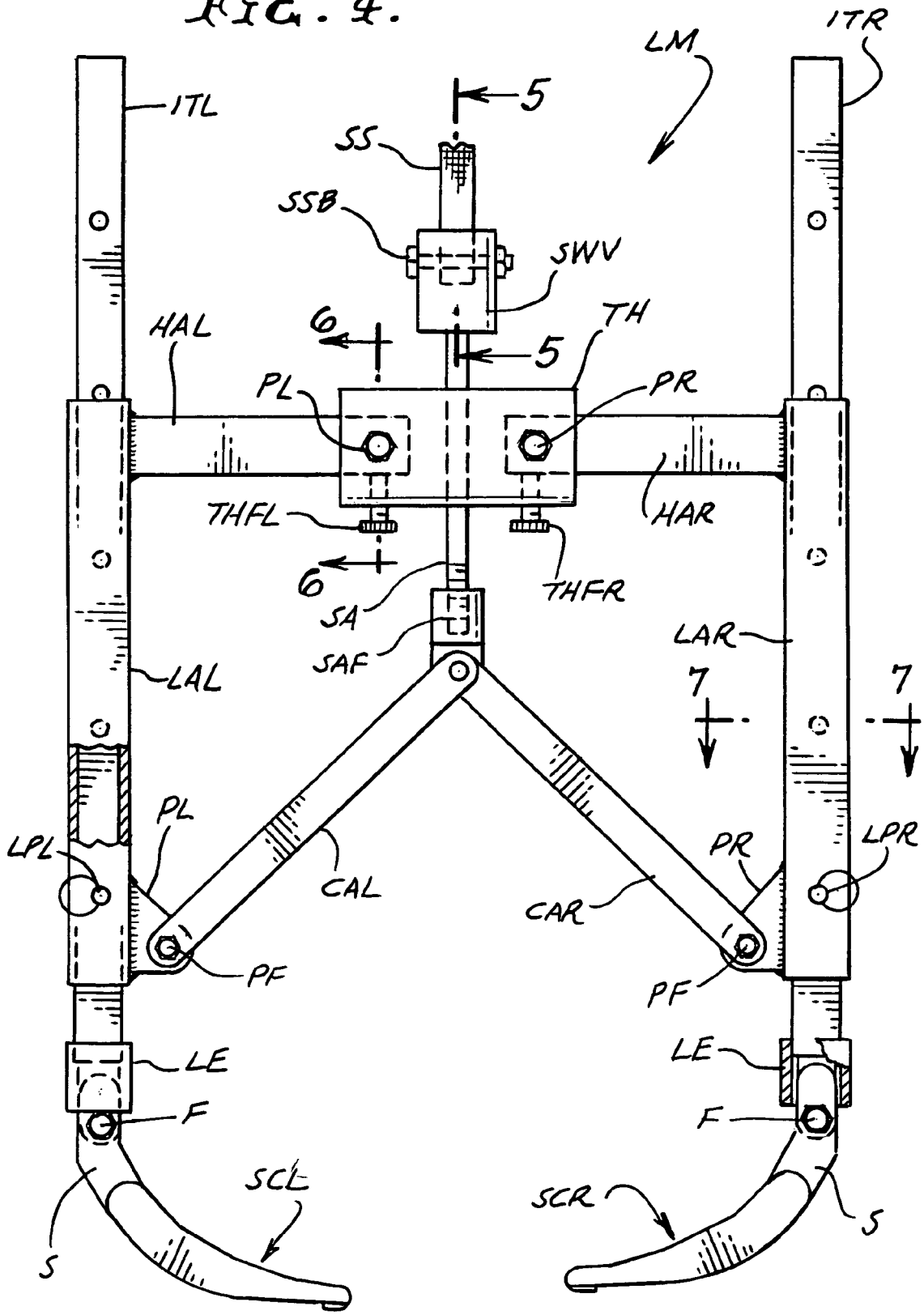
FIG. 4 is a view taken along the line 4-4 of FIG. 3.
Figure 10:
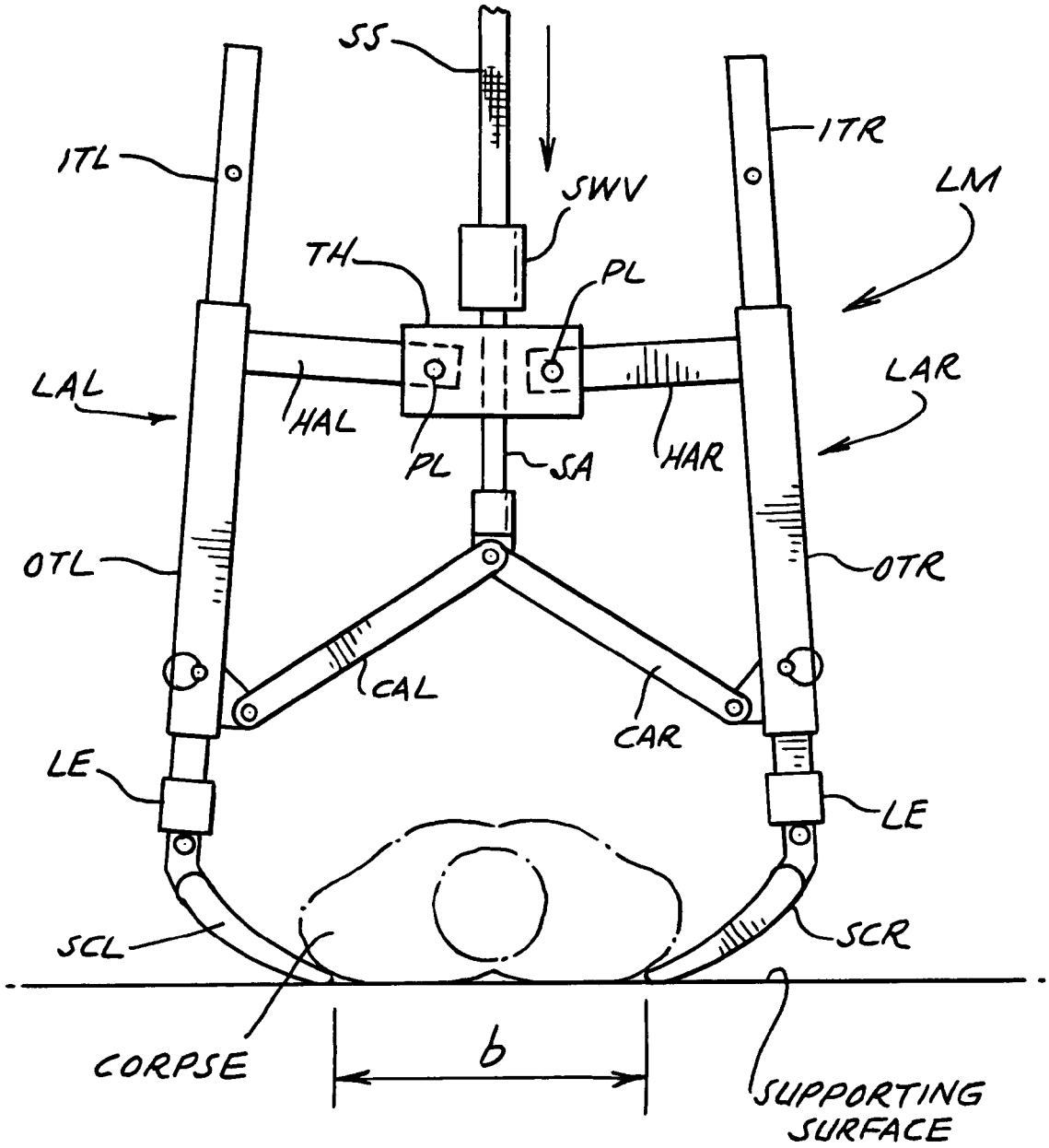
FIG. 10 is a partial, front elevational view of the lifting mechanism as illustrated in FIG. 2 and illustrated with the lifting arms of the mechanism in a pivoted open position to move over a body, illustrated in dotted outline, and the mechanism's scooping elements separated by a distance "b" immediately prior to the scooping elements closing under the body.
Figure 11:
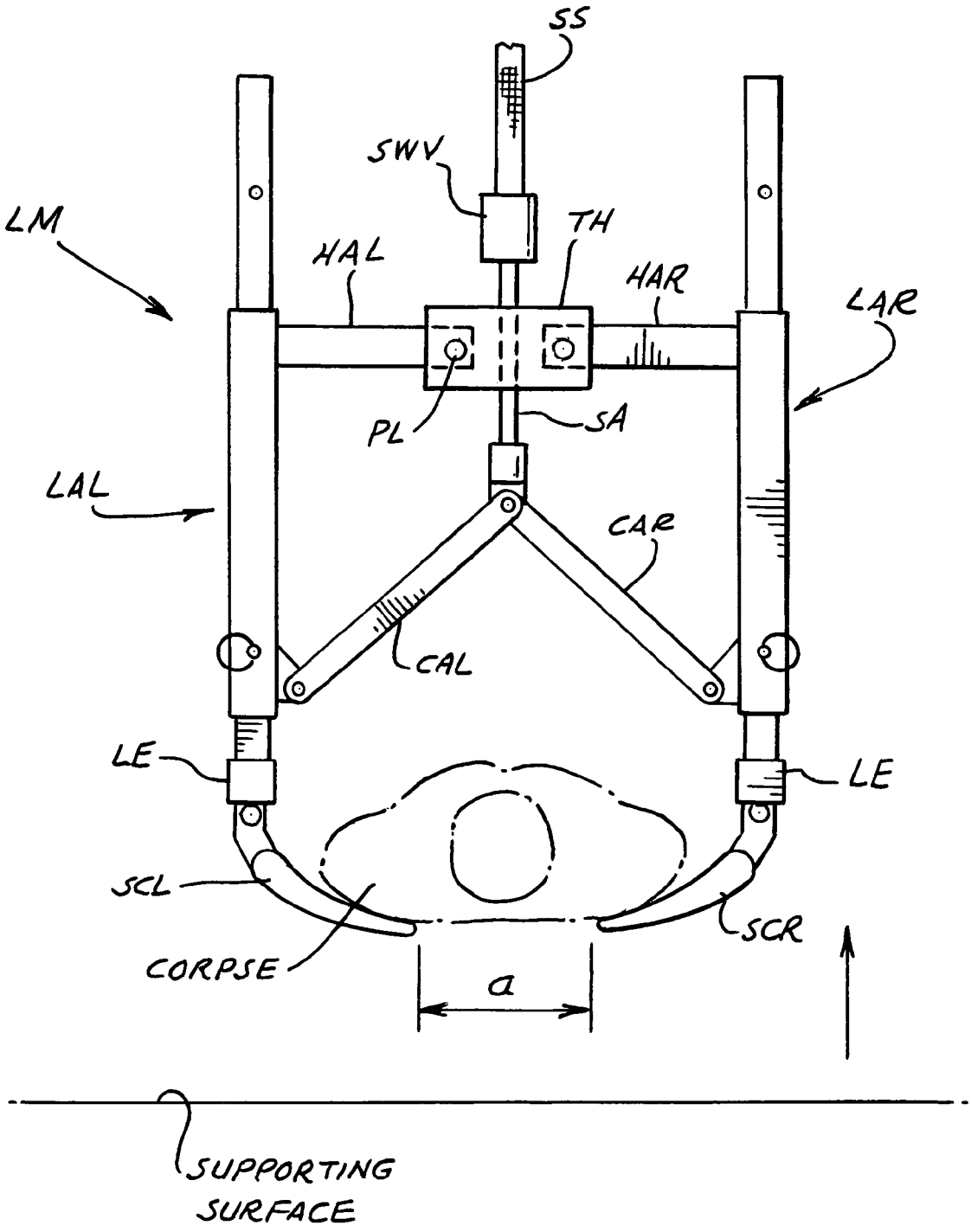
FIG. 11 is a view similar to FIG. 10 but illustrating the lifting mechanism having the scooping elements closed under the body to be lifted and separated by a distance "a"

Referring specifically to FIGS. 2-4 the body lifting mechanism LM construction will be examined. The lifting mechanism LM comprises a pair of lifting arms identified as the arms LAL and LAR arranged in a U-like configuration as best illustrated in FIGS. 2 and 4 with a horizontal arm HA. As illustrated in the drawings, the three arms of the U-like configuration is oriented in an inverted U-like configuration with the arms LAL and LAR being secured adjacent the ends of the horizontal arm HA such as by welding. Each of the lifting arms comprise a pair of tubular elements that are arranged in a telescopic arrangement for relative movement between the tubular elements to permit the operative lengths of the arms LAL and LAR to be adjustable in length in accordance with the width of the object or body to be lifted. To this end, the lifting arm LAL comprises an outer tubular element OTL and an inner tubular element ITL. The tubular elements are all illustrated in the form of rectangular tubular elements but may take any other form that permits the adjustment of the lengths of the lifting arms LAL and LAR. Similarly, the tubular elements for the lifting arm LAR are identified as the outer tubular element OTR and the inner tubular element ITR. The lifting arms LAL and LAR are rendered adjustable in length by the provision of a series of adjusting apertures AA spaced apart along the lengths of the inner tubular elements ITL and ITR as can be best appreciated by viewing FIG. 12. For this purpose, the outer tubular elements OTL and OTR are provided with an adjusting apertures OAL and OAR spaced equally from the lower ends of the tubular elements OTL and OTR, as illustrated, for alignment with the selected apertures AA for the elements ITL and ITR. Once the aperture OAR, for example, for the tubular element OTR is aligned with the selected aperture AA for the tubular element ITL, they may be locked in position by means of a locking pin LPR inserted in the concentrically aligned apertures, as best seen in FIG. 3 wherein the locking pin is identified as the pin LPL. Similarly, a locking pin LPL secures the tubular elements comprising the lifting arm LAL, as illustrated. The operative lengths of the inner tubular elements ITL and ITR are the lengths extending outwardly of their coacting tubular elements OTL and OTR are the same. Also, the inner tubular elements may be of a length to extend outwardly of their respective outer tubular elements OTL and OTR upwardly of the horizontal arm HA, as best seen in FIGS. 4, 10 and 11.

The lifting mechanism LM illustrated may be constructed of any material having sufficient structural strength for supporting objects and/or human bodies to be elevated and supported and may be constructed of steel. In the disclosed embodiment of the invention the elements of the lifting mechanism LM are constructed of stainless steel and preferably stainless steel that has been highly polished.

Figure 6:
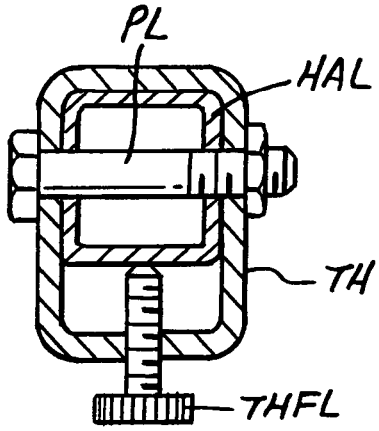
FIG. 6 is a sectional view taken along the line 6-6 of FIG. 4.
Figure 7:
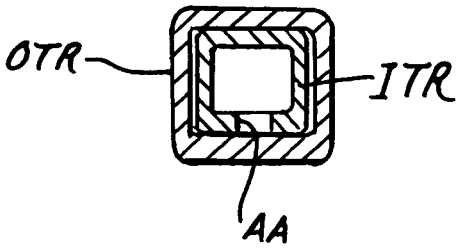
FIG. 7 is a sectional view taken along the line 7-7 of FIG. 4.
Figure 8:
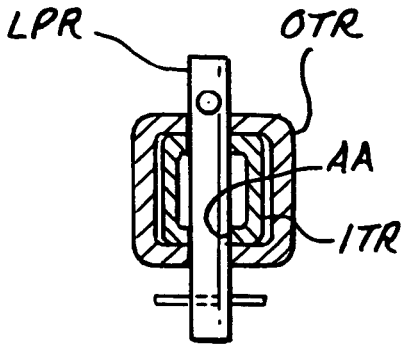
FIG. 8 is a sectional view taken along the line 8-8 of FIG. 3.

The U configuration of the lifting mechanism LM is completed by the selected construction therefore, namely, a pair of short tubular elements HAL and HAR horizontally aligned between the lifting arms LAL and LAR, as can be appreciated from viewing FIG. 4. As illustrated, one end of each of the elements HAL and HAR are secured by welding to the adjacent end of the lifting arms or any other form of fastening. The lengths of the elements HAL and HAR are selected to provide a space of a pre-selected distance between the inner ends of these elements; see FIG. 4. These inner ends are secured by the provision of a tubular housing TH extending between the inner ends of the elements HAL and HAR and housing the ends therein. These inner ends are locked to the housing TH by the provision of locking fasteners THFL and THFR. The elements HAL and HAR are constructed and defined to be pivotable by the provision of individual pivot fasteners PL and PR secured between the housing TH and the individual elements HAL and HAR, as best seen in FIG. 6 for the left hand element HAL. The pivot element may take the form of a conventional fastener mounted in a suitable aperture and having one end secured by a nut; see FIG. 6. The construction of the pivots is to pivotably move the associated lifting arm outwardly of its normal vertical position as will be evident hereinafter. Each of the elements HAL and HAR are constructed the same.

Figure 5:
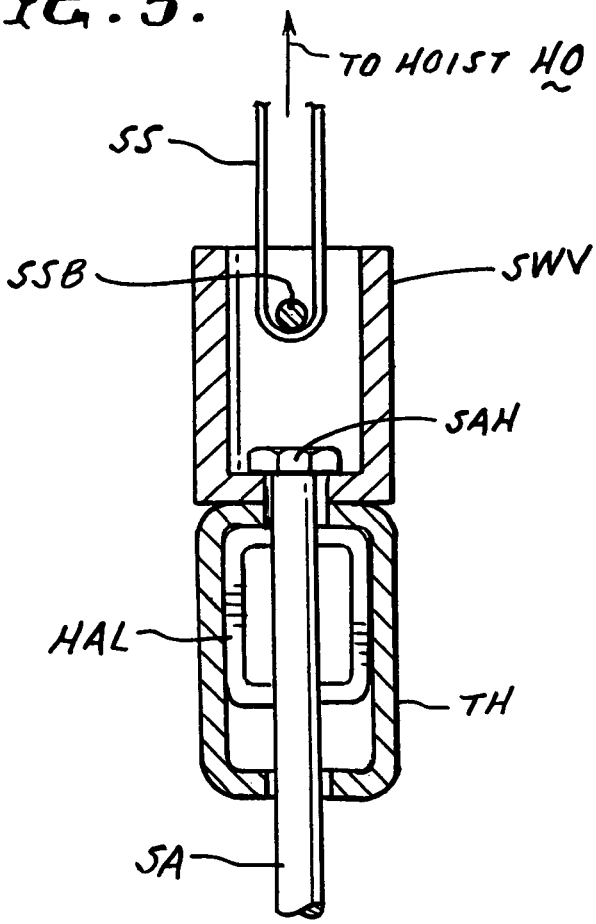
FIG. 5 is partial, sectional view. Taken along the line 5-5 of FIG. 4.

The remaining elements of the improved lifting mechanism LM are constructed, defined and proportioned with a supporting arm SA positioned through the housing TH between the spaced ends of the elements HAL and HAR for the horizontal arm HA and extend outwardly from the top and bottom surfaces of the housing TH. The portion of the supporting arm SA extending below the bottom surface of the housing TH extends a pre-selected distance downwardly thereof to accommodate a pair of cross arms CAL and CAR having one end secured in common adjacent the bottom of the lower end of the supporting arm SA. The supporting arm in the practical embodiment illustrated is a bolt that extends through the housing TH and has a head SAH on one end as illustrated in FIG. 5. The lower end of the arm SA is illustrated as threaded and mounting a fastener SAF secured thereto for securing together the ends of the cross arms CAL and CAR thereto. To provide a pivoting action to the lifting arms LAL and LAR, each lifting arm has welded thereto a triangular like pivoting element secured adjacent the lower ends of the lifting arms and extending inwardly of the arms, as illustrated in FIGS. 2 and 4, the pivoting element for the lifting arm LAL is welded to the outer tubular element OTL and is designated by the reference character PL. The cross arm CAL has its free end pivotably secured to the element PL by a fastener. Similarly, the cross arm CAR is secured to the pivoting element PR by means of a fastener PF. The pivoting action is designed to move the lifting arms outwardly of the normal vertical position to spread the lifting arms further apart for straddling the body or object to be lifted.

Figure 9:
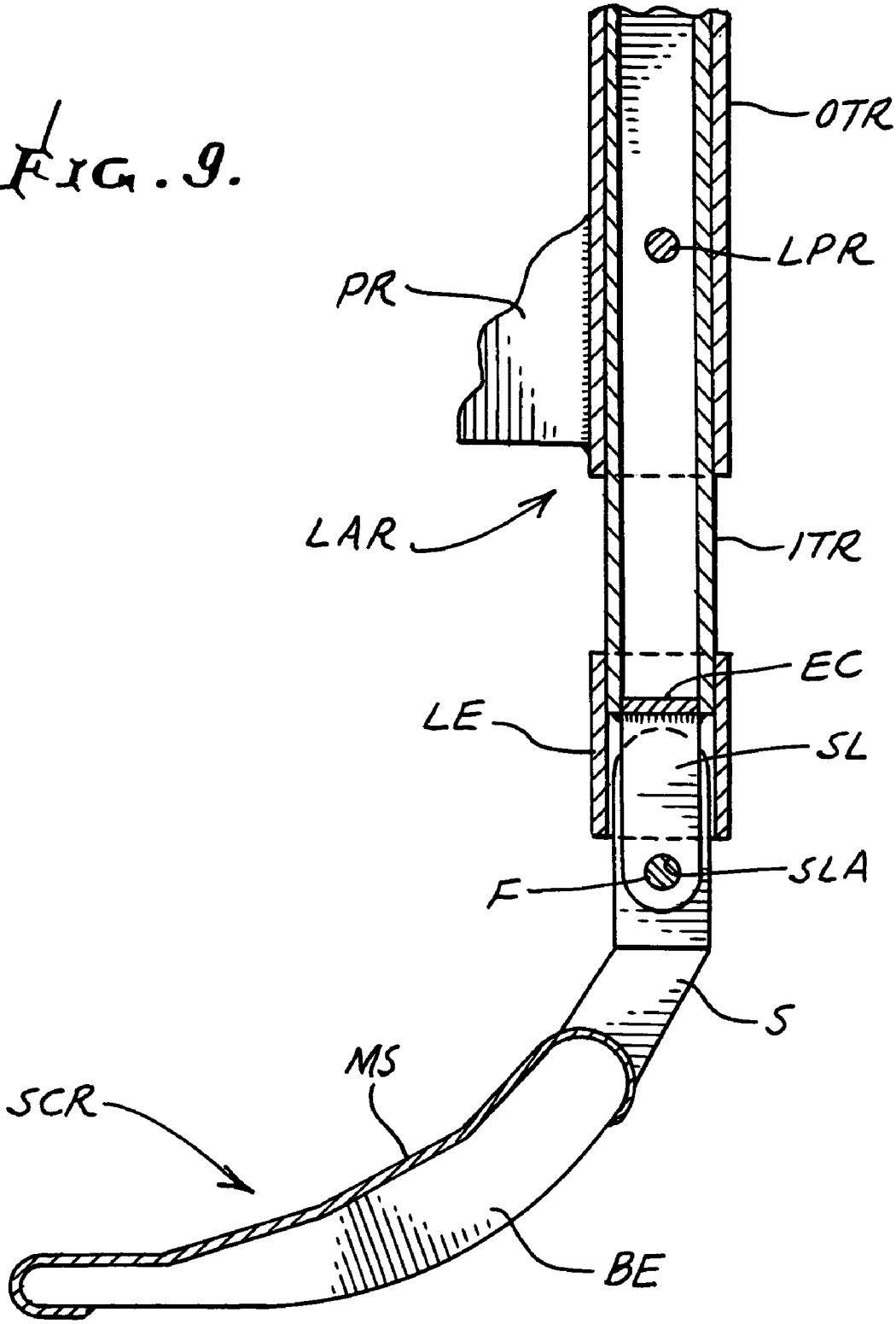
FIG. 9 is a partial, sectional view taken along the line 9-9 of FIG. 3.

The lifting arms LAL and LAR are completed by the provision of a pair of arcuate scooping elements SCL and SCR secured to the arms LAL and LAR respectively. The scooping elements are constructed of stainless steel and mounted with their arcuate surfaces facing each other as illustrated in the drawings, in particular, FIGS. 2 and 4. The structure for securing the scoop elements SCL and SCR to the arms LAL and LAR respectively will be described with particular reference to FIGS. 3 and 9. The scoop elements SCL and SCR are of a pre-selected length and in one practical embodiment is on the order of 7 inches in length. The scoop elements are both constructed identically and comprise arcuate shaped end plates at opposite ends thereof and identified as SCE. There is provided a pair of bracing elements BE intermediate the ends and which brace elements extend outwardly from the scoop elements for securement to the lifting arms. The scoop elements construction is completed by wrapping a metallic skin MS such as a 14 gauge stainless steel around the end pieces and the bracing elements and welding the skin MS to elements BE to form the arcuate configuration as best illustrated in FIG. 3. The outwardly extending ends of the brace elements BE are utilized to secure the scoop elements to their respective lifting arms, as best illustrated in FIGS. 3 and 9.

To couple the scoop elements SCR and SCL to the lifting arms in a secure relationship therewith so the scoop elements do not move during the lifting operation, the brace elements BE for each scoop element are provided with a spacer S at the outer ends thereof. The structure for connecting the scoop element SCR to the lifting arm LAR and in particular to the inner tubular element ITR, as illustrated in FIG. 9 will be the only one described in detail as the same construction is utilized for connecting the lifting arm LAL to the associated scoop element SCL. The spacer S may be a block of stainless steel shaped to fit it between the braces BE fitting partially within the scoop element SCR and the remainder of the spacer S extending outwardly thereof at a pre-selected angle. The spacer S is secured at its outer end to a spine SL having an angular relationship with the spacer S when secured thereto. The spine SL may be a bifurcated, stainless steel plate on the order of ¼ inch thick and have a fastener mounting aperture SLA arranged intermediate its ends; see FIGS. 3 and 9. The spine SL is mounted between the brace elements BE that are coaxially arranged with the spine aperture SLA for receiving a fastener F secured thereto. The angular relationships for the spacer S, spine SL are selected to allow connection to the scoop element SCR at angular relationship to the vertical lifting arm LAR at approximately a right angle thereto as illustrated. For this purpose the inner tubular element ITR is provided with an end cap EC and in turn is welded to the spine SL. The spine SL and the spacer S are welded together with the opposite end of the spacer S welded to the metallic skin MS as best illustrated FIG. 9. To assure that the scoop element SCR is maintained in the desired angular relationship with the body or object to be lifted and not move away from that position the lifting arm LAR is provided with a movable locking element LE in the form of a short tubular steel element movably mounted adjacent the end of inner tubular element ITR and overlapping the end a pre-selected extent. The locking element LE has a length to extend from the tubular element ITR to overlap the spine SL short of the position fastener F and in this arrangement locks up the brace elements BE and spine SL as best illustrated in FIG. 9. The locking element LE is slidable on the tubular element ITR upwardly from its locked position of FIG. 9 to free the scoop element SCR. When the locking element is moved upwardly from the position illustrated in FIG. 9 or upwardly onto the tubular element ITR it may be retained in the unlocked position by means of a magnet mounted to the tubular element ITR. The magnet is selected to have the necessary magnetic force to retain the locking element LE in the desired unlocking position. The magnet is not shown in the drawings. The magnetic force of the magnet is overcome by moving the element LE back down to its locking position.

The upper portion of the supporting arm SA mounts a swivel SWV for housing the suspension strap SS for the hoist mechanism suspended from the room ceiling as illustrated in FIGS. 1 and 2. The ceiling mounted rail and hoist transport that is commercially available from Guldmann, Inc. USA of 5505 Johns Road, Suite 700, Tampa, Fla. 33634. The rail R is secured to the room ceiling and has a length governed by positioning of the table or gurney or wheeled platform mounting the body or object to be transported and the location of the receptacle such as a casket for receiving the body or object lifted and transported by the hoist along the rail. As illustrated in FIG. 1, the rail R will run on the ceiling laterally from the body supporting platform to the casket. For this purpose the hoist HO is mounted to be supported on and ride on the rail R in response to electrical signals provided by the hoist operator or mortician actuating the hand control HC, illustrated as mounted to the top of the lifting arm LAL. The Guldmann hoist generally comprises a horizontal lift motor for controlling the positioning of a strap SS for elevating or lowering the lifting mechanism LM as commanded by the hoist operator OP through operation of the hand control HC. The control HC is electrically connected between the control HC and the hoist HO by means of a cable CB. The hoist HO is also commanded to move laterally on the rail R in response to the operation of the appropriate command therefore by the operator OP.

The swivel SWV houses the strap SS and at one end the head SAH for the supporting arm SA as best viewed in FIG. 5. The strap SS is coupled around a bolt SSB extending across the swivel housing and is secured thereto (see FIG. 4). By coupling the supporting strap SS around the bolt SSB, the lifting mechanism LM is suspended from the ceiling. The strap SS is controlled by the Guldmann lift motors to play out the strap SS for lowering the lifting mechanism LM or retract the strap SS for elevating the lifting mechanism. In this manner the operator OP can control the desired action from the hand control HC for moving the lifting mechanism LM up and down for lifting a body or object. It will be recognized by those skilled in the art that a room equipped with a hoist for lifting objects may be utilized for the purposes of the present invention by merely coupling the hoist to the lifting mechanism LM.

With the above description in mind of the lifting mechanism LM and with reference to the drawings the operation of the lifting mechanism LM will be described. The mechanism will be describes as it may be utilized for lifting a corpse that has been prepared for burial for transport into a casket in a manner illustrated in FIG. 1. The arrangement is such that the lifting of the corpse may be accomplished by the mortician alone, without the need of further workers, and without the need to handle the corpse. To this end, as illustrated in FIG. 1, the prepared corpse is positioned on a wheeled platform under the lifting mechanism LM. It will be assumed that the corpse is one of average size and the lifting arms LAL and LAR have been adjusted in length to provide sufficient space between the scoop elements SCL and SCR to allow them to straddle the corpse when lowered to the supporting surface for the corpse as seen in FIG. 1. The operator OP of the Hand Control HC in this instance may be the mortician. The mortician has the controls in hand and operates the controls to lower the lifting mechanism LM downwardly to cause the scoop elements SCR and SCL to engage the supporting surface for the corpse so that the scoop elements straddle the body as illustrated in FIG. 10. In this view the space between the scoop elements is identified as the space "b". At this point the operator continues to call for the continued descent of the mechanism LM and the engagement of the scoop elements with the corpse supporting surface causes the forces to move the scoop elements under the body from both sides for engaging the body to allow it to be carried on the scoop elements; i.e. the body is scooped by the elements SCL and SCR in preparation to be elevated. The operator OP then actuates the hand control HC to command the elevating forces to be applied to the lifting mechanism LM and the body is elevated above the supporting surface.

Figure 12:
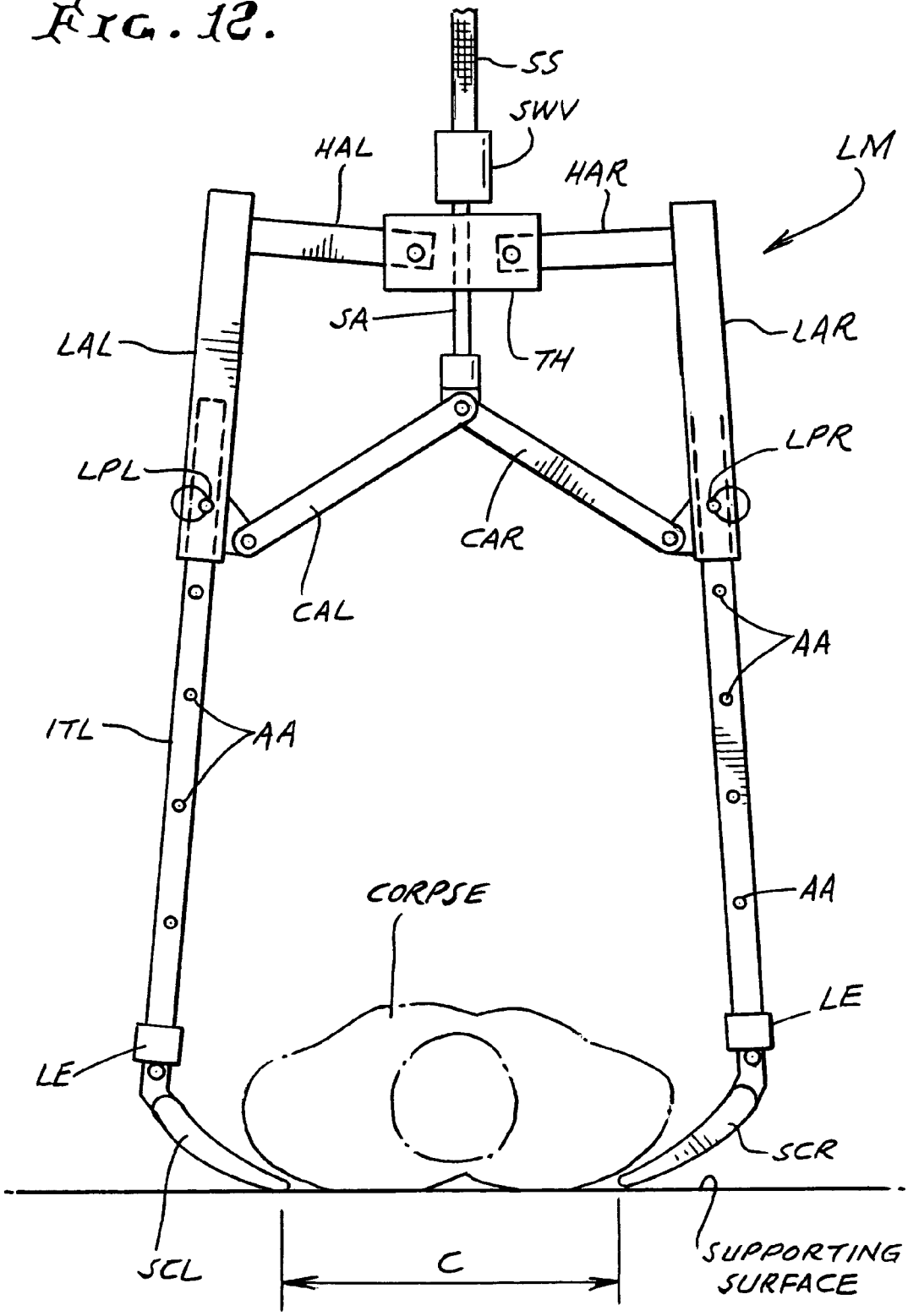
FIG. 12 is a view similar to FIGS. 10 and 11 but illustrated with the lifting mechanism adjusted to allow bodies of enlarged sizes, one being illustrated in dotted outline, to be accommodated for lifting by the present invention, and illustrated in the pivoted, fully open position with the separation of the mechanism's scooping elements illustrated as separated by a distance designated "c", immediately prior to the scooping elements closing under the body to be lifted.

At this point, it should be noted that the Operator Mortician has not lifted the corpse but merely operates the hand controls HC to lower the lifting mechanism and again to elevate the mechanism supporting and carrying the corpse upwardly. Note in particular in FIG. 11. the spacing between the scoop elements is defined by the shorter spacing of the scoop elements identified by the space "a", a shorter distance than the space "b" of FIG. 10. The operator OP further elevates the lifting mechanism LM to a suitable height for transporting the body, in this instance to the casket and then actuates the hand controls HC to cause the hoist HO to travel on the rail to the point the body is to be deposited, in this instance the casket close by, and lowers the lifting mechanism to deposit the corpse in the casket To further illustrate the versatility and usefulness of the improved lifting mechanism LM of the present invention with reference to FIG. 12 it will be explained how it may be employed to lift and transport an object of an unusual configuration such as the corpse that is above average weight and size, that in the past may have required 3 workers to handle and move the body around. The oversized corpse is illustrated in FIG. 12 in dotted outline arranged on a supporting surface. For this lifting operation the usual spacing "b" (FIG. 10) between the scoop elements is not sufficient to straddle the corpse but a spacing "c" as defined in FIG. 12 is required. The lifting mechanism LM is first adjusted to increase the length of the lifting arms LAL and LAR by releasing their respective locking pins LPL and LPR to permit the inner tubular elements ITL and ITR to be withdrawn from their outer tubular elements OTL and OTR downwardly to their full extent. In the position illustrated in FIG. 12, the topmost adjusting aperture AA are aligned with the adjusting apertures OAL and OAR for the outer tubular elements OTL and OTR, respectively. The released locking pins are then mounted to these aligned apertures to lock the inner tubular elements in position as illustrated in FIG. 12 to cause the spreading apart of the scoop elements. The spacing between the scoop elements is also increased in response to the downward forces applied to the lifting mechanism LM by these forces acting against the supporting surface to cause the outward movement of the lifting arms LAL and LAR due to the pivotal response of the cross arms CAL and CAR along with the horizontal elements HAL and HAR pivoting the lifting arms outwardly to achieve the desired spacing "c" for the mechanism of FIG. 12. The spacing identified as "c" is greater than the spacing "b" of FIG. 10.

It should now be evident to one skilled in the lifting mechanism art that the above described invention has advanced the state of the art that allows bodies or objects of various sizes and shapes to be accommodated and positioned to be scooped up for lifting by the use of a single person without the need for lifting the object to be lifted and when lifted moved to a second location, such as the location of a casket in the case of corpses of varying sizes. The invention is not limited to the described scooping elements as lifting means but in lieu thereof may be utilized with a sling for mounting physically impaired individuals or individuals requiring improvement in their physical skills.

The invention claimed is:

1. A body lifting mechanism comprising a U-shaped element having two vertical arms spaced apart a pre-selected distance and a horizontal arm secured between the vertical arms adjacent the ends of the vertical arms, the U-shaped element normally arranged in an inverted U-configuration, said vertical arms having a pre-selected operative length and being constructed and defined by telescoping arms for relative movement for permitting the lengths of said arms to be adjusted in length and secured to the adjusted lengths, the operative lengths of said vertical arms being the same including when adjusted from said pre-selected length, a supporting arm mounted to extend through said horizontal arm pre-selected distances on opposite sides of said horizontal arm and carried thereby, an end of said arm extending above said horizontal arm for coupling the supporting arm to a source for imparting vertical movements, up and down, to said U-shaped element, a pair of cross arms for said U-shaped element, the remaining end of said supporting arm including means for securing an end of each of said cross arms thereto, the remaining ends of said cross arms being individually, pivotably secured to an individual one of said vertical arms adjacent the lower ends of said vertical arms and to permit said vertical arms to fully open in combination with the elongation of the vertical arms for permitting objects of an enlarged width to be engaged from opposite sides to be elevated and transported, lifting means for supporting an object or body to be elevated and transported in said lifting means secured to the ends of the vertical arms, said pivoting occurring in response to the application of a downwardly driving force to position the ends of the vertical arms against the supporting surface for an object or body to be elevated via said lifting means, said downwardly driving force causing said vertical arms to each pivot outwardly.

2. A body lifting mechanism as defined in claim 1 wherein said lifting means comprises a scoop means, one for each vertical arm, secured to each vertical arm, each of said scoop means have a pre-selected length and having a pre-selected arcuate configuration secured to the individual vertical arm opening toward the other vertical arm, and individual means for securing said scoop means in a non-movable position relative to said individual vertical arm.

3. A body lifting mechanism as defined in claim 1 including motor control means securable to the ceiling of a room and operative for elevating and lowering said thus defined body lifting mechanism, said motor control means including dependent belt means coupled to said supporting arm for controlling the vertical movements thereof, and a hand control electrically connected to said motor control means for actuating the vertical movements of the body lifting mechanism.

4. A body lifting mechanism as defined in claim 1 including ceiling mounted rails and ceiling mounted hoist adapted to ride on the rails for transferring a body elevated and supported by said body lifting mechanism to another location for permitting said body to be deposited at said another location, means for coupling said hoist to said body lifting mechanism, and manually operated control means for operating the hoist for elevating and lowering said body lifting mechanism and to cause said hoist to travel on said rails to laterally position said body lifting mechanism.

5. A body lifting mechanism adapted to be mounted to and suspended from the ceiling of a room for elevating a body from a supporting surface and transporting the elevated body to another surface, comprising a U-shaped element having two vertical arms and a horizontal arm secured between the vertical arms adjacent the ends of the vertical arms, the U-shaped element is normally arranged in an inverted U configuration when said element is suspended from the ceiling of the room, the arms of the U-shaped element being constructed and defined by tubular elements rigidly connected together to form said U-shaped element, each vertical arm of said U-shaped element comprising an outer tubular element and an inner tubular element movably mounted within each outer tubular element in a telescopic relationship, each of the inner elements being of a length to extend downwardly beyond the ends of the outer tubular elements for each of said vertical arms, means for securing said inner and outer tubular elements for the individual vertical arms in a non-movable relationship so that the inner tubular elements extend a pre-selected distance downwardly beyond the ends of said outer tubular elements, the lengths of the inner tubular elements extending beyond said outer tubular elements being substantially the same for said two vertical arms, said horizontal arm of said U-shaped element comprising a pair of tubular sections each of a pre-selected length, each of said tubular sections have one end secured to an individual vertical arm and both are arranged in horizontal alignment for forming said horizontal arm for said U-shaped element, the pair of tubular sections having each of the remaining ends of the tubular sections being spaced apart a pre-selected distance, housing means constructed and defined of a tubular element and arranged with said spaced apart ends of each of said pair of tubular sections for receiving and housing the individual ends of said pair of tubular sections for completing the horizontal arm of said U-shaped element, means for pivotably securing each of said individual ends of said pair of tubular sections to said housing means, individual means for locking the individual tubular sections to said housing means, a supporting arm extending through said housing means and mounted between the pivotably secured ends of said pair of tubular sections and extending outwardly of both ends of said housing means a pre-selected distance, a pair of cross arms for said U-shaped element, the downwardly extending portion of said supporting arm including means for securing together one of the ends of each of the pair of cross arms, one end of each of said pair of cross arms being individually secured to said securing means for said supporting arm, each of the other ends of the cross arms having an end individually, and pivotably secured to one of said vertical arms adjacent an end thereof for pivotably moving the vertical arms outwardly of the vertical position to permit said vertical arms to fully open in combination with the elongation of the vertical arms for permitting objects of an enlarged width to be engaged from opposite sides to be elevated and transported, lifting means for supporting a body to be elevated and transported in said lifting means, said pivoting occurring in response to the application of a downwardly driving force to position the ends of the vertical arms against the supporting surface for an object or body to be elevated via said lifting means, said downwardly driving force causing said vertical arms to each pivot outwardly, and means for non-movably securing said lifting means to each of said vertical arms of the U-shaped element for elevation and transport to be movable with said lifting mechanism.

6. A body lifting mechanism as defined in claim 5 wherein said lifting means comprises scoop means individually connected to each of said vertical arms, said scoop means being arranged with their scooping surfaces facing each other for enclosing on an object to be elevated.

7. A body lifting mechanism comprising a U-shaped element having two vertical arms spaced apart a pre-selected distance and a horizontal arm secured between the vertical arms adjacent the ends of the vertical arms the U-shaped element normally arranged in an inverted U-configuration, said vertical arms having a pre-selected operative length and being constructed and defined for permitting the lengths of said arms to be adjusted in length and secured to the adjusted lengths, the operative lengths of said vertical arms being the same including when adjusted from said pre-selected length, each of said vertical arms comprising a pair of tubular elements arranged in a movable, telescoped relationship wherein the operating length of each vertical arm can be adjusted by displacing one of the tubular elements relative to the other, and means for securing the pair of tubular elements for a single arm at a pre-selected length, in accordance with the size of the object to be lifted, a supporting arm mounted to extend through said horizontal arm pre-selected distances on opposite sides of said horizontal arm and carried thereby, the end of said arm extending above said horizontal arm for coupling to the arms for imparting vertical movements to said U-shaped elements, a pair of cross arms for said U-shaped element, the remaining end of said supporting arm including means for securing an end of each of said cross arms thereto, the remaining ends of said cross arms being individually, pivotably secured to one of said vertical arms adjacent the lower end thereof to permit said vertical arms to fully open in combination with the elongation of the vertical arms for permitting objects of an enlarged width to be engaged from opposite sides to be elevated and transported, and scoop means secured to the lower operative ends of each of said vertical arms in a non-movable relationship, said pivoting occurring in response to the application of a downwardly driving force to position the ends of the vertical arms against the supporting surface for an object or body to be elevated via scoop means, said downwardly driving force causing said vertical arms to each pivot outwardly.

8. A method of lifting objects including the steps of:

providing a lifting mechanism having a pair of spaced, vertically extending lifting arms connected with substantially horizontal arm connecting said pair of lifting arms to form a U-shaped structure, orienting the U-shaped structure so the lifting arms depend downwardly from said horizontal arm in an inverted U-configuration, the lifting arms for the lifting mechanism comprising telescoping arms for relative movement and being adjustable in length in accordance with the size of an object to be lifted, adjusting the lifting arms to a pre-selected length in accordance with the size of the object to be lifted for permitting the lifting arms to straddle the object to be lifted, adding a lifting element to the Lifting mechanism to be carried by the lifting arms adjacent the lower ends of the lifting arms so as to be operative for movement under the object to be lifted to allow the object to be lifted to be carried by the lifting elements, providing an object to be lifted wherein the object resides on a supporting surface, moving the lifting mechanism downwardly for engaging the supporting surface for the object to be lifted to a straddling position with the object to be lifted and in engagement with the supporting surface, continuously applying a downwardly movement to the lifting mechanism for causing the lifting element carried by the lifting arms to move under the object to be lifted to be supported by the lifting element, and then applying a lifting force to said lifting mechanism when the lifting element supports the object to be lifted and lifting the thus supported object away from the supporting surface.

9. A method for lifting objects as defined in claim 8 wherein the lifting arms and horizontal arm are each characterized as being pivotable a pre-selected amount with the adjustability of the lifting arms to cause the lifting arms to straddle an object to be lifted of abnormal width or size and to be carried thereby, and wherein the steps of applying a downwardly movement to the lifting mechanism causes the lifting arms to straddle said object to be lifted and moved under said object by the lowering and pivoting action of the lifting arms and horizontal arm in response to the lifting arms engaging the supporting surface to allow said object to be carried thereby.

10. A method of lifting objects as defined in claim 8 or 9 wherein the step of adding a lifting element to the lifting mechanism includes releasably locking the lifting element in place to prevent movement thereof during the lifting of an object.

11. A method of lifting and transferring a body from one location to another and capable of execution by a single person including the steps of:

mounting a pre-selected rail and hoist structure to the ceiling of a room in a body handling room, the hoist being capable of exerting vertical forces for elevating and lowering a body coupled to the hoist and laterally transferring a hoisted body from one location to another location upon traveling along said rail structure, manually controlling the hoist for actuating the hoist for elevating or lowering a body to be transferred and manually actuating the hoist for travel along the rail structure for transferring the hoisted body to another lateral location for preparation, dressing or casketing or other similar operations, providing a lifting mechanism having a pair of spaced vertically, oriented lifting arms having arcuate scooping elements dependent from the arms in a predetermined, non-movable angular relationship for scooping up and lifting the scooped body in response to the operation of the hoist for lowering the vertical arms to position the scooping elements on the opposite sides of the body to be transferred, the lifting mechanism including a pivoting structure constructed and defined with said vertical lifting arms to be pivotable outwardly in response to the downward forces positioning the ends of the arms in engagement with the supporting surface of the body to be transferred and causing the scooping elements to move under said body to be supported thereon so as to allow lifting away said body from the supporting surface without the need for the hoist operator moving said body, suspending said lifting mechanism from said hoist structure, operating the hoist structure for causing the scooping elements to be moved downwardly toward the body to be transferred and the continuous actuation of the vertical lifting arms in a downward direction to cause said arms to engage the supporting surface for said body on the opposite sides of the body and for causing said scooping elements to move under the body and close under the body, operating the hoist to cause the scooped body to be hoisted above its supporting surface a pre-selected distance, and operating the hoist to ride on the rail structure and transfer the hoisted body to another location.

12. A method of lifting and transferring a body as defined in claim 11 including the step of adjusting the vertical lengths of the lifting arms of the lifting mechanism to cause the lifting arms to be pivotably spread apart laterally for accommodating bodies of an enlarged size to be lifted and transported by said lifting mechanism.

13. A method of lifting and transferring a body as defined in claim 12 wherein the step of adjusting the vertical lengths of the lifting arms include the steps of increasing the length of each of the lifting arms for said lifting mechanism to cause the large sized bodies to be scooped up and supported by said scooping elements for hoisting and transfer by the scooping elements for the lifting mechanism.

14. A method of lifting and transferring a body as defined in claim 11 or 12 wherein said lifting arms each comprise a pair of tubular elements arranged in a movable, telescoped relationship to be movable one relative to its telescoped pair for increasing the operative length of the lifting arms to cause pre-selected amounts of separation between the lifting arms and secured together at said pre-selected lengths including the length for accommodating large sized bodies.

* * * * *